US009595269B2

(12) United States Patent
Chebiyyam et al.

(10) Patent No.: US 9,595,269 B2
(45) Date of Patent: Mar. 14, 2017

(54) SCALING FOR GAIN SHAPE CIRCUITRY

(71) Applicant: QUALCOMM Incorporated, San Diego, CA (US)

(72) Inventors: Venkata Subrahmanyam Chandra Sekhar Chebiyyam, San Diego, CA (US); Venkatraman S. Atti, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/939,436

(22) Filed: Nov. 12, 2015

(65) Prior Publication Data

US 2016/0210978 A1 Jul. 21, 2016

Related U.S. Application Data

(60) Provisional application No. 62/105,071, filed on Jan. 19, 2015.

(51) Int. Cl.

| | |
|---|---|
| ***G10L 21/038*** | (2013.01) |
| ***G10L 19/083*** | (2013.01) |
| ***G10L 19/032*** | (2013.01) |

(52) U.S. Cl.

CPC ..... *G10L 19/083* (2013.01); *G10L 19/032* (2013.01); *G10L 21/038* (2013.01)

(58) Field of Classification Search

None

See application file for complete search history.

(56) References Cited

U.S. PATENT DOCUMENTS

| | | | | |
|---|---|---|---|---|
| 7,526,348 | B1 * | 4/2009 | Marshall | H04S 1/007 381/107 |
| 8,078,474 | B2 * | 12/2011 | Vos | G10L 19/0208 704/500 |
| 2005/0004793 | A1 * | 1/2005 | Ojala | G10L 21/038 704/219 |
| 2008/0027718 | A1 | 1/2008 | Krishnan et al. | |
| 2011/0218797 | A1 * | 9/2011 | Mittal | G10L 19/20 704/200 |
| 2015/0081064 | A1 * | 3/2015 | Ball | G06F 17/3074 700/94 |

OTHER PUBLICATIONS

International Search Report and Written Opinion—PCT/US2016/012718—ISA/EPO—Mar. 21, 2016, 12 pages.

(Continued)

*Primary Examiner* — Abul Azad
(74) *Attorney, Agent, or Firm* — Toler Law Group, PC

(57) ABSTRACT

A method of operation of a device includes receiving a first set of samples and a second set of samples. The first set of samples corresponds to a portion of a first audio frame and the second set of samples corresponds to a second audio frame. The method further includes generating a target set of samples based on the first set of samples and a first subset of the second set of samples and generating a reference set of samples based at least partially on a second subset of the second set of samples. The method also includes scaling the target set of samples to generate a scaled target set of samples and generating a third set of samples based on the scaled target set of samples and one or more samples of the second set of samples.

62 Claims, 7 Drawing Sheets

(56) References Cited

OTHER PUBLICATIONS

Deshpande, M.M., et al., "A Novel BWE Scheme based on Spectral Peaks in G.729 Compressed Domain," 2005 13th European Signal Processing Conference, IEEE, Sep. 4, 2005 (Sep. 4, 2005), pp. 1-4, XP032759293, ISBN: 978-1-60423-821-1 [retrieved on Apr. 1, 2015].

* cited by examiner

SCALING FOR GAIN SHAPE CIRCUITRY

I. CROSS-REFERENCE TO RELATED APPLICATION(S)

This application claims the benefit of U.S. Provisional Patent Application No. 62/105,071, filed Jan. 19, 2015 and entitled "SCALING FOR GAIN SHAPE CIRCUITRY," the disclosure of which is incorporated by reference herein in its entirety.

II. FIELD

This disclosure is generally related to signal processing, such as signal processing performed in connection with wireless audio communications and audio storage.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

A wireless telephone (or other electronic device) may record and reproduce speech and other sounds, such as music. For example, to support a telephone conversation, a transmitting device may perform operations to transmit a representation of an audio signal, such as recorded speech (e.g., by recording the speech, digitizing the speech, coding the speech, etc.), to a receiving device via a communication network.

To further illustrate, some coding techniques include encoding and transmitting the lower frequency portion of a signal (e.g., 50 Hz to 7 kHz, also called the "low-band"). For example, the low-band may be represented using filter parameters and/or a low-band excitation signal. In order to improve coding efficiency, the higher frequency portion of the signal (e.g., 7 kHz to 16 kHz, also called the "high-band") may not be fully encoded and transmitted. Instead, a receiver may utilize signal modeling and/or data associated with the high-band ("side information") to predict the high-band.

In some circumstances, a "mismatch" of energy levels may occur between frames of the high-band. However, some processing operations associated with encoding of frames performed by a transmitting device and synthesis of the frames at a receiving device may cause energy of one frame to overlap with (or "leak" into) another frame. As a result, certain decoding operations performed by a receiving device to generate (or predict) the high-band may cause artifacts in a reproduced audio signal, resulting in poor audio quality.

IV. SUMMARY

A device (such as a mobile device that communicates within a wireless communication network) may compensate for inter-frame overlap (e.g., energy "leakage") between a first set of samples associated with a first audio frame and a second set of samples associated with a second audio frame by generating a target set of samples that corresponds to the inter-frame overlap. The device may also generate a reference set of samples associated with the second audio frame. The device may scale the target set of samples based on the reference set of samples, such as by reducing an energy difference between the target set of samples and the reference set of samples.

In an illustrative implementation, the device communicates in a wireless network based on a 3rd Generation Partnership Project (3GPP) enhanced voice services (EVS) protocol that uses gain shape circuitry to gain shape a synthesized high-band signal. The device may scale the target set of samples and "replace" the target set of samples with the scaled target set of samples prior to inputting the synthesized high-band signal to the gain shape circuitry, which may reduce or eliminate certain artifacts associated with the inter-frame overlap. For example, scaling the target set of samples may reduce or eliminate artifacts caused by a transmitter/receiver mismatch of a seed value (referred to as "bwe_seed") associated the 3GPP EVS protocol.

In a particular example, a method of operation of a device includes receiving a first set of samples and a second set of samples. The first set of samples corresponds to a portion of a first audio frame and the second set of samples corresponds to a second audio frame. The method further includes generating a target set of samples based on the first set of samples and a first subset of the second set of samples and generating a reference set of samples based at least partially on a second subset of the second set of samples. The method includes scaling the target set of samples to generate a scaled target set of samples and generating a third set of samples based on the scaled target set of samples and one or more samples of the second set of samples.

In another particular example, an apparatus includes a memory configured to receive a first set of samples and a second set of samples. The first set of samples corresponds to a portion of a first audio frame and the second set of samples corresponds to a second audio frame. The apparatus further includes a windower configured to generate a target set of samples based on the first set of samples and a first subset of the second set of samples. The windower is configured to generate a reference set of samples based at least partially on a second subset of the second set of samples. The apparatus further includes a scaler configured to scale the target set of samples to generate a scaled target set of samples and a combiner configured to generate a third set of samples based on the scaled target set of samples and one or more samples of the second set of samples.

In another particular example, a computer-readable medium stores instructions executable by a processor to perform operations. The operations include receiving a first set of samples and a second set of samples. The first set of samples corresponds to a portion of a first audio frame and the second set of samples corresponds to a second audio frame. The operations further include generating a target set of samples based on the first set of samples and a first subset of the second set of samples and generating a reference set of samples based at least partially on a second subset of the second set of samples. The operations further include scaling the target set of samples to generate a scaled target set of samples and generating a third set of samples based on the scaled target set of samples and one or more samples of the second set of samples.

In another particular example, an apparatus includes means for receiving a first set of samples and a second set of samples. The first set of samples corresponds to a portion of a first audio frame and the second set of samples corresponds to a second audio frame. The apparatus further includes means for generating a target set of samples and a reference set of samples. The target set of samples is based on the first set of samples and a first subset of the second set of samples, and the reference set of samples is based at least partially on a second subset of the second set of samples. The apparatus further includes means for scaling the target set of samples to generate a scaled target set of samples and means for generating a third set of samples based on the scaled target set of samples and one or more samples of the second set of samples.

One particular advantage provided by at least one of the disclosed embodiments is improved quality of audio reproduced at a receiving device, such as a wireless communication device that receives information corresponding to audio transmitted in a wireless network in connection with a telephone conversation. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
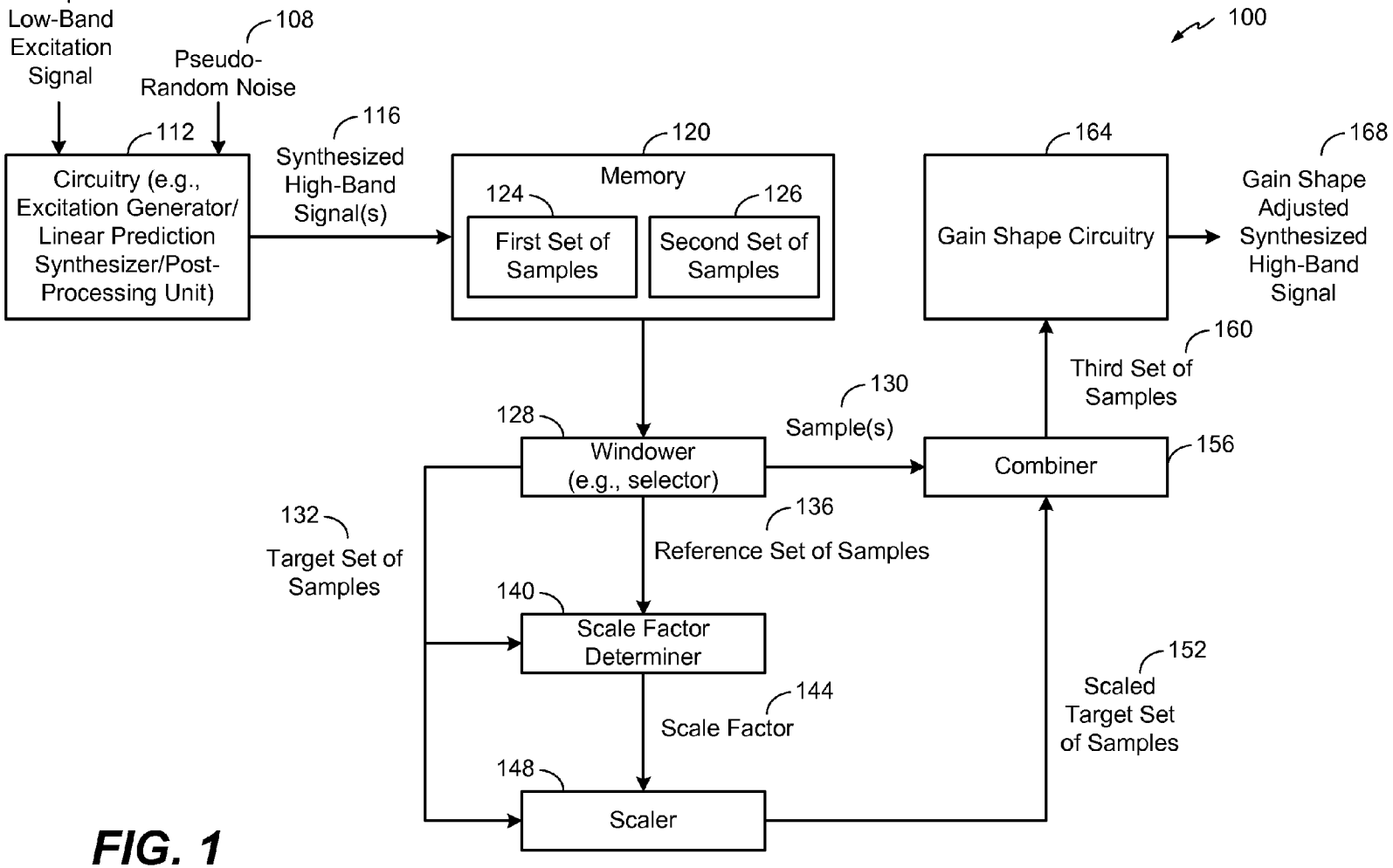
FIG. 1 is a block diagram of an illustrative example of a device, such as a decoder, within a wireless communication device, that may compensate for energy discontinuity at an inter-frame overlap.

FIG. 1 depicts certain illustrative aspects of a device 100. To illustrate, the device 100 may be integrated within an encoder or within a decoder of an electronic device, such as a wireless communication device that sends and receives data packets within a wireless communication network using a transceiver coupled to the device 100. In other cases, the device 100 may be integrated within another electronic device, such as a wired device (e.g., a modem or a set top box, as illustrative examples).

In some implementations, the device 100 operates in compliance with a 3GPP standard, such as the 3GPP EVS standard used by wireless communication devices to communicate within a wireless communication network. The 3GPP EVS standard may specify certain decoding operations to be performed by a decoder, and the decoding operations may be performed by the device 100 to decode information received via a wireless communication network. Although certain examples of FIG. 1 are described with reference to a decoder, is noted that aspects described with reference to FIG. 1 (and other examples described herein) may also be implemented at an encoder, such as described further with reference to FIG. 7. Further, in some implementations, aspects of the disclosure may be implemented in connection with one or more other protocols, such as a Moving Picture Experts Group (MPEG) protocol for data encoding, data decoding, or both.

The device 100 may include circuitry 112 coupled to a memory 120. The circuitry 112 may include one or more of an excitation generator, a linear prediction synthesizer, or a post-processing unit, as illustrative examples. The memory 120 may include a buffer, as an illustrative example.

The device 100 may further include a windower 128 coupled to a scale factor determiner 140. The scale factor determiner 140 may be coupled to a scaler 148. The scaler 148 may be coupled to the windower 128 and to a combiner 156. The combiner 156 may be coupled to a gain shape processing module, such as gain shape circuitry 164. The gain shape circuitry 164 may include a gain shape adjuster (e.g., in connection with a decoder implementation of the device 100) or a gain shape parameter generator that generates gain shape information (e.g., in connection with an encoder having one or more features corresponding to the device 100).

In operation, the circuitry 112 may be responsive to a low-band excitation signal 104. The circuitry 112 may be configured to generate synthesized high-band signals, such as a synthesized high-band signal 116, based on a high-band excitation signal generated using the low-band excitation signal 104 and high-band envelope-modulated noise using pseudo-random noise 108. The synthesized high-band signal 116 may correspond to sets of samples of audio frames (e.g., data packets received by a wireless communication device using a wireless communication network) that are associated with an audio signal (e.g., a signal representing speech). For example, the circuitry 112 may be configured to generate a first set of samples 124 and a second set of samples 126. The first set of samples 124 and the second set of samples 126 may correspond to synthesized high-band signals that are generated based on the low-band excitation signal 104 using an excitation generator of the circuitry 112, a linear prediction synthesizer of the circuitry 112, and a post-processing unit of the circuitry 112. In another implementation, the first set of samples 124 and the second set of samples 126 correspond to a high-band excitation signal that is generated based on a low-band excitation signal (e.g., the low-band excitation signal 104) using an excitation generator of the circuitry 112. The circuitry 112 may be configured to provide the first set of samples 124 and the second set of samples 126 to the memory 120. The memory 120 may be configured to receive the first set of samples 124 and the second set of samples 126.

The first set of samples 124 may be associated with a first audio frame, and the second set of samples 126 may be associated with a second audio frame. The first audio frame may be associated with (e.g., processed by the device 100 during) a first time interval, and the second set of samples 126 may be associated with (e.g., processed by the device 100 during) a second time interval that occurs after the first time interval. The first audio frame may be referred to as a "previous audio frame," and the second audio frame may be referred to as a "current audio frame." However, it should be understood that "previous" and "current" are labels used to distinguish between sequential frames in an audio signal and do not necessarily indicate real-time synthesis limitations. In some cases, if the second set of samples 126 corresponds to an initial (or first) audio frame of a signal to be processed by the device 100, the first set of samples 124 may include values of zero (e.g., the memory 120 may be initialized by the device 100 using a zero padding technique prior to processing the signal).

In connection with certain protocols, a boundary between audio frames may cause energy "leakage" from a previous audio frame to a current audio frame. As a non-limiting example, a protocol may specify that an input to a gain shape device (such as the gain shape circuitry 164) is to be generated by concatenating a first number of samples of a previous audio frame (e.g., the last 20 samples, as an illustrative example) with a second number of samples of a current audio frame (e.g., 320 samples, as an illustrative example). In this example, the first number of samples corresponds to the first set of samples 124. As another example, a particular number of samples of the current audio frame (e.g., the first 10 samples, as an illustrative example) may be affected by the previous audio frame (e.g., due to operation of the circuitry 112, such as a filter memory used in linear predictive coding synthesis operations and/or post processing operations). Such "leakage" (or inter-frame overlap) may result in amplitude differences (or "jumps") in a time domain audio waveform that is generated based on the sets of samples 124, 126. In these non-limiting, illustrative examples, the memory 120 may be configured to store the last 20 samples of the previous audio frame (such as the first set of samples 124) concatenated with 320 samples of the current audio frame (such as the second set of samples 126).

The windower 128 may be configured to access samples stored at the memory 120 and to generate a target set of samples 132 and a reference set of samples 136. To illustrate, the windower 128 may be configured to generate the target set of samples 132 using a first window and to generate the reference set of samples 136 using a second window. In an illustrative example, the windower 128 is configured to select the first set of samples 124 and a first subset of the second set of samples 126 to generate the target set of samples 132 and to select a second subset of the second set of samples 126 to generate the reference set of samples 136. In this example, the windower 128 may include a selector (e.g., a multiplexer) configured to access the memory 120. In this case, the first window and the second window do not overlap (and the target set of samples 132 and the reference set of samples 136 do not "share" one or more samples). By not "sharing" one or more samples, implementation of the device 100 can be simplified in some cases. For example, the windower 128 may include selection logic configured to select the target set of samples 132 and the reference set of samples 136. In this example, "windowing" operations performed by the windower 128 may include selecting the target set of samples 132 and the reference set of samples 136.

In another illustrative implementation, the target set of samples 132 and the reference set of samples 136 each include "weighted" samples of the first subset of the second set of samples 126 (e.g., samples that are weighted based on proximity to a frame boundary separating the first set of samples 124 and the second set of samples 126). In this illustrative example, the windower 128 is configured to generate the target set of samples 132 and the reference set of samples 136 based on the first set of samples 124, the first subset of the second set of samples 126, and the second subset of the second set of samples 126. Further, in this example, the first window and the second window overlap (and the target set of samples 132 and the reference set of samples 136 "share" one or more samples). A "shared" sample may be "weighted" based on a proximity of the sample to an audio frame boundary (which may improve accuracy of certain operations performed by the device 100 in some cases). Certain illustrative aspects that may be associated with the windower 128 are described further with reference to FIGS. 2 and 3. Weighting using the first window and second window may be performed by the scale factor determiner 140, such as described further with reference to FIGS. 4 and 5.

The scale factor determiner 140 may be configured to receive the target set of samples 136 and the reference set of samples 132 from the windower 128. The scale factor determiner 140 may be configured to determine a scale factor 144 based on the target set of samples 132 and the reference set of samples 136. In a particular illustrative example, the scale factor determiner 140 is configured to determine a first energy parameter associated with the target set of samples 132, to determine a second energy parameter associated with the reference set of samples 136, to determine a ratio of the second energy parameter and the first energy parameter, and to perform a square root operation on the ratio to generate the scale factor 144. Certain illustrative features of the scale factor determiner 140 are described further with reference to FIGS. 4 and 5.

The scaler 148 may be configured to receive the target set of samples 132 and the scale factor 144. The scaler 148 may be configured to scale the target set of samples 132 based on the scale factor 144 and to generate a scaled target set of samples 152.

The combiner 156 may be configured to receive the scaled target set of samples 152 and to generate a third set of samples 160 based on the scaled target set of samples 152 and based further on one or more samples 130 of the second set of samples 126 (also referred to herein as "remaining" samples of the second set of samples 126). For example, the one or more samples 130 may include "unsealed" samples of the second set of samples 126 that are not provided to the scaler 148 and that are not scaled by the scaler 148.

In the example of FIG. 1, the windower 128 may be configured to provide the one or more samples 130 to the combiner 156. Alternatively or in addition, the combiner 156 may be configured to receive the one or more samples 130 using another technique, for example by accessing the memory 120 using a connection between the memory 120 and the combiner 156. Because scaling operations performed by the device 100 may be based on a ratio of energies of the sets of samples 124, 126, a discontinuity in energy levels between audio frames corresponding to the sets of samples 124, 126 may be "smoothed." "Smoothing" the energy discontinuity may improve quality of an audio signal generated based on the sets of samples 124, 126 (e.g., by reducing or eliminating artifacts in the audio signal that result from the energy discontinuity).

The gain shape circuitry 164 is configured to receive the third set of samples 160. For example, the gain shape circuitry 164 may be configured to estimate gain shapes based on the third set of samples 160 (e.g., in connection with an encoding process performed by an encoder that includes the device 100). Alternatively or in addition, the gain shape circuitry 164 may be configured to generate a gain shape adjusted synthesized high-band signal 168 based on the third set of samples 160 (e.g., by applying gain shapes in connection with either a decoding process performed at a decoder or an encoding process performed at an encoder that includes the device 100). For example, the gain shape circuitry 164 is configured to gain shape the third set of samples 160 (e.g., in accordance with a 3GPP EVS protocol) to generate the gain shape adjusted synthesized high-band signal 168. As an illustrative example, the gain shape circuitry 164 may be configured to gain shape the third set of samples 160 using one or more operations specified by 3GPP technical specification number 26.445, section 6.1.5.1.12, version 12.4.0. Alternatively or in addition, the gain shape circuitry 164 may be configured to perform gain shaping using one or more other operations.

Because the target set of samples 132 includes one or more samples of both the first set of samples 124 and the second set of samples 126 that are directly impacted by an energy level of the first set of samples 124, the scaling performed by the device 100 of FIG. 1 based on the energy ratio may compensate for artifacts due to energy discontinuity effects associated with inter-frame overlap (or "leakage") between the first set of samples 124 and the second set of samples 126. Compensating for energy discontinuities at the inter-frame overlap may reduce discontinuities (or "jumps") in the gain shape adjusted synthesized high-band signal 168, improving quality of an audio signal that is generated based on the sets of samples 124, 126 at an electronic device that includes the device 100.

Figure 2:
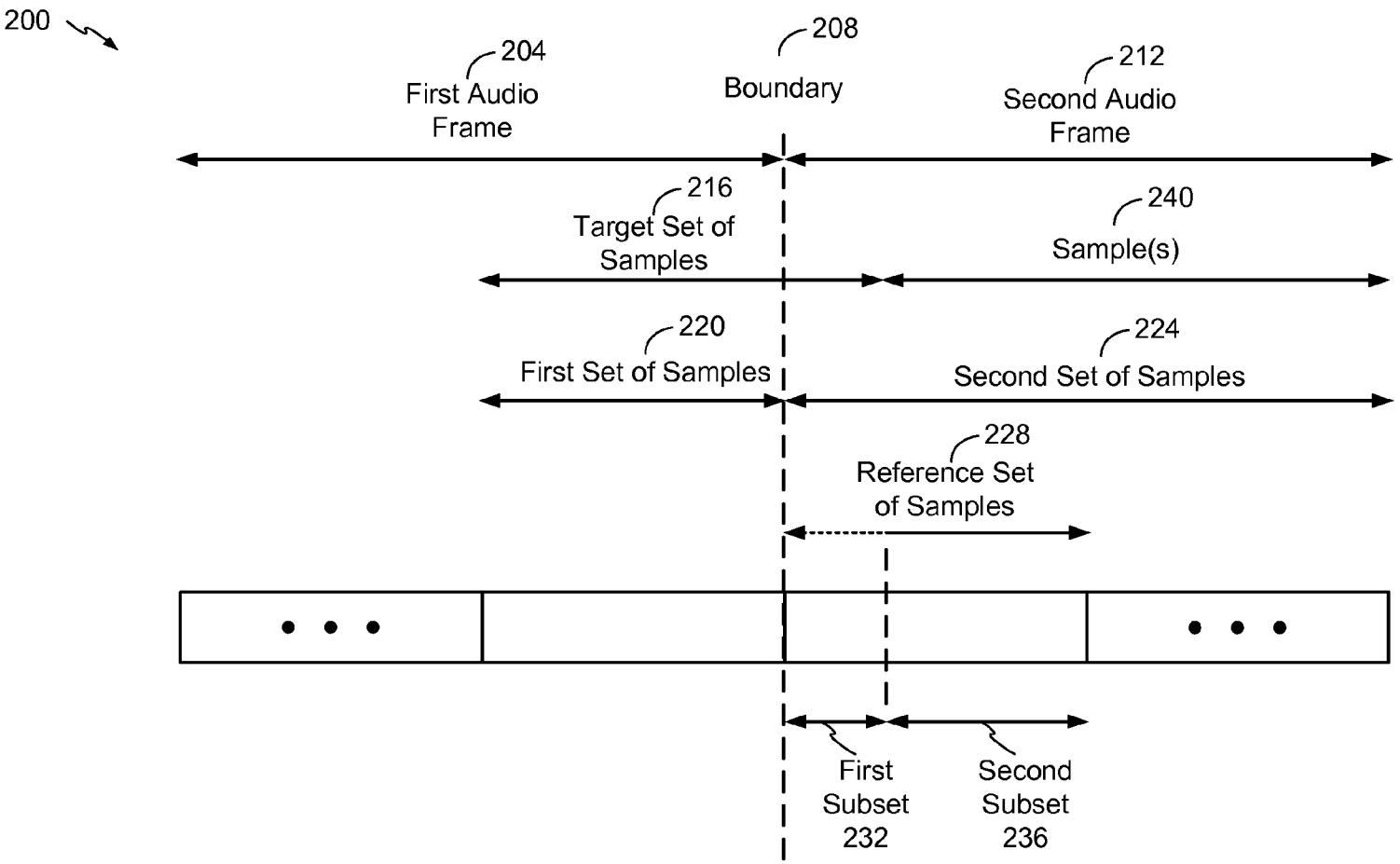
FIG. 2 depicts illustrative examples of audio frames that may be associated with operation of a device, such as the device of FIG. 1.

FIG. 2 depicts illustrative examples of audio frames 200 associated with operation of a device, such as the device 100 of FIG. 1. The audio frames 200 may include a first audio frame 204 (e.g., the first audio frame described with reference to FIG. 1, which may correspond to a previous audio frame) and a second audio frame 212 (e.g., the second audio frame described with reference to FIG. 1, which may correspond to a current audio frame). The illustrative example of FIG. 2 depicts that the first audio frame 204 and the second audio frame 212 may be separated by a frame boundary, such as a boundary 208.

The first audio frame 204 may precede the second audio frame 212. For example, the first audio frame 204 may sequentially precede immediately before the second audio frame 212 in an order of processing of the first audio frame 204 and the second audio frame 212 (e.g., an order in which the first audio frame 204 and the second audio frame 212 are accessed from the memory 120 of FIG. 1, as an illustrative example).

The first audio frame 204 may include a first portion, such as a first set of samples 220 (e.g., the first set of samples 124 of FIG. 1). The second audio frame 212 may include a second portion, such as a second set of samples 224 (e.g., the second set of samples 126 of FIG. 1).

The second set of samples 224 may include a first subset 232 (e.g., the first subset described with reference to FIG. 1) and a second subset 236 (e.g., the second subset described with reference to FIG. 1). As an illustrative, non-limiting example, where tenth-order linear prediction coding is used, the first subset 232 may include the first 10 samples of the second audio frame 212, and the second subset 236 may include the next 20 samples of the second audio frame 212. In an alternative illustrative, non-limiting example, the first subset 232 may include the first 10 samples of the second audio frame 212, and the second subset 236 may include the next 30 samples of the second audio frame 212. In other implementations, the first subset 232 and/or the second subset 236 may include different samples of the second audio frame 212.

FIG. 2 further illustrates an example of a target set of samples 216 (e.g., the target set of samples 132 of FIG. 1) and one or more samples 240 (e.g., the one or more samples 130 of FIG. 1). The one or more samples 240 may include one or more samples of the second set of samples 224 that are not included in the first subset 232 (also referred to herein as one or more "remaining" samples of the second set of samples 224). In the example of FIG. 2, the target set of samples 216 includes the first set of samples 220 and the first subset 232. As an illustrative, non-limiting example, the target set of samples 216 may include the last 20 samples of the first audio frame 204 and the first 10 samples of the second audio frame 212. In other implementations, the target set of samples 220 may include different samples of the first audio frame 204 and/or the second audio frame 212.

FIG. 2 also depicts an example of a reference set of samples 228 (e.g., the reference set of samples 136 of FIG. 1). In the example of FIG. 2, the reference set of samples 228 includes the first subset 232 and the second subset 236. In this case, the target set of samples 216 and the reference set of samples 228 may "share" the first subset 232. In other examples, the target set of samples 216 may include different samples than illustrated in FIG. 2. For example, in another implementation, the reference set of samples 228 includes the second subset 236 and does not include the first subset 232 (indicated in FIG. 2 as a partially broken line representing the reference set of samples 228). In this example, the target set of samples 216 and the reference set of samples 228 do not "share" one or more samples. In some implementations, the number of samples in the target set of samples 216 equals the number of samples in the reference set of samples 228.

In some implementations, a set of samples stored in the memory 120 may include samples from a previous set of samples. For example, a portion of the first audio frame 204 (e.g., the first set of samples 220) may be concatenated with the second set of samples 224. Alternatively or in addition, in some cases, linear predictive coding and/or post processing operations performed by the circuitry 112 may cause sample values of the first subset 232 to depend on sample values of the first audio frame 204 (or a portion thereof). Thus, the target set of samples 216 may correspond to an inter-frame "overlap" between the first audio frame 204 and the second audio frame 212. The inter-frame overlap may be based on a total number of samples on either side of the boundary 208 that are directly impacted by the first audio frame 204 and that are used during processing of the second audio frame 212.

Referring again to FIG. 1, the windower 128 may be configured to generate the target set of samples 132 and/or the target set of samples 216 based on a number of samples associated with a length of the inter-frame overlap between the first audio frame 204 and the second audio frame 212. To illustrate, the length may be 30 samples, or another number of samples. In certain cases, the length may change dynamically during operation of the device 100 (e.g., based on a frame length change, a linear predictive coding order change, and/or another parameter change). The windower 128 may be responsive to or integrated within another device (e.g., a processor) that identifies the length (or estimated length) of the inter-frame overlap (e.g., based on a protocol, such as a 3GPP EVS protocol) and that provides an indication of the length to the windower 128. The windower 128 may be configured to store an indication of the length and/or position of the inter-frame overlap, such as at a memory and/or in connection with execution of instructions by the processor.

By scaling the target set of samples 216 based on the length of the inter-frame overlap, a device may compensate for the inter-frame overlap associated with the boundary 208. For example, an energy difference between the first audio frame 204 and the second audio frame 212 may be "smoothed," which may reduce or eliminate an amplitude "jump" in an audio signal at a position corresponding to the boundary 208. An example of a "smoothed" signal is described further with reference to FIG. 3.

Figure 3:
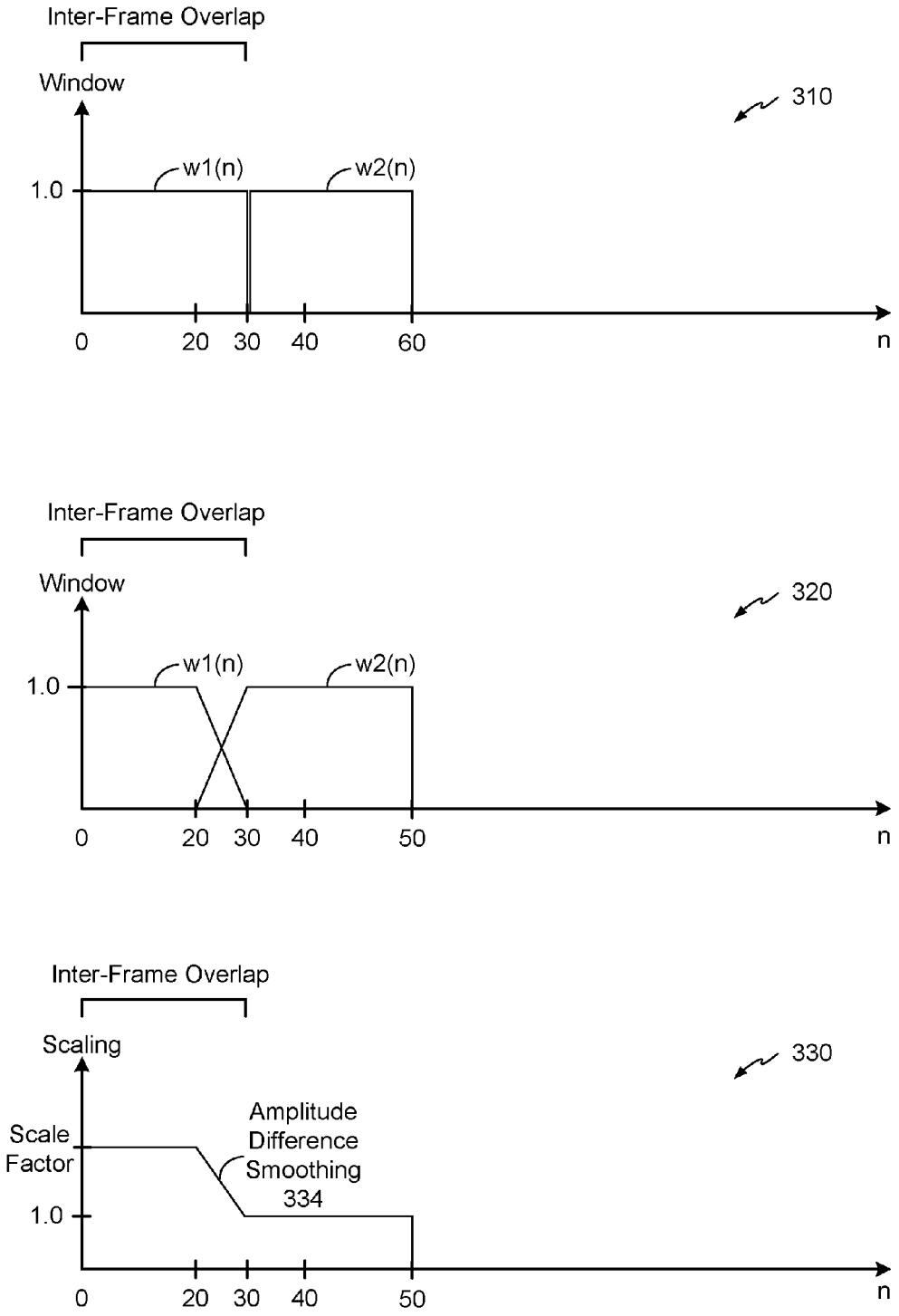
FIG. 3 depicts illustrative aspects associated with operation of a device, such as the device of FIG. 1.

FIG. 3 depicts illustrative examples of a graph 310, a graph 320, and a graph 330. The graphs 310, 320, and 330 may be associated with operation of a device, such as the device 100 of FIG. 1. In each of the graphs, 310, 320, and 330, the abscissa indicates a number of samples "n," where "n" is an integer greater than or equal to zero. In each of the graphs 310 and 320, the ordinate indicates a window value. In the graph 330, the ordinate indicates a scale factor value.

The graph 310 illustrates a first example of a first window w1(*n*) and a second window w2(*n*). Referring again to FIGS. 1 and 2, the windower 128 may be configured to generate the target set of samples 132 based on the first window w1(*n*) (e.g., by selecting the first set of samples 220 and the first subset 232 using the first window w1(*n*)). The windower 128 may be configured to generate the reference set of samples 136 based on the second window w2(*n*) (e.g., by selecting the second subset 236 using the second window w2(*n*)). It should be noted that in this illustrative example, the windows w1(*n*) and w2(*n*) have a value of 1.0. These windows illustrate a case where windowing does not modify a signal (e.g., where a target set of samples and a reference set of samples are selected by the windower 128 and the scale factor determiner 140 of FIG. 1 without scaling by the windower 128 or by the scale factor determiner 140). In this case, a "windowed" target set would include the same values as the target set of samples 132 or the target set of samples 216, and the "windowed" reference set of samples would include the same values as the reference set of samples 136 or the reference set of samples 228.

The graph 320 illustrates a second example of the first window w1(*n*) and the second window w2(*n*). The windower 128 may be configured to generate the target set of samples 132 based on the first window w1(*n*) (e.g., by selecting the first set of samples 220 and the first subset 232 to generate the target set of samples 132 and by weighting the first set of samples 220 and the first subset 232 according to the first window w1(*n*) in order to generate a weighted target set of samples). The windower 128 may be configured to generate the reference set of samples 136 based on the second window w2(*n*) (e.g., by selecting the subsets 232, 236 to generate a reference set of samples and by weighting the subsets 232, 236 according to the second window w2(*n*) in order to generate a weighted reference set of samples).

The graph 330 illustrates aspects of a scaling process that may be performed by the scaler 148. In the graph 330, a value of a scale factor (e.g., the scale factor 144) that is applied to a target set of samples (e.g., any of the window selected target sets of samples 132, 216) is changed gradually near the boundary 208 (represented in the graph 330 as amplitude difference smoothing 334). The amplitude difference smoothing 334 may enable a gain transition or "taper" (e.g., a smooth gain transition, such as a smooth linear gain transition) from scaling based on the scale factor 144 to a scale factor of one (or no scaling), which may avoid a discontinuity (e.g., a "jump") in an amount of scaling near the boundary 208. In this example, any of the target sets of samples 132, 216 may be scaled using a linear gain transition from a first value of the scale factor ("scale factor" in the example of the graph 330) to a second value of the scale factor ("1" in the example of the graph 330). It should be noted the graph 330 is provided for illustration and that other examples are within the scope of the disclosure. For example, although the graph 330 depicts that the first value of the scale factor may be greater than the second value of scale factor, in other illustrative examples, the first value of the scale factor may be less than or equal to the second value of the scale factor. To further illustrate, referring again to FIG. 1, the scale factor determiner 140 may be configured to scale the target set of samples 132 using a linear gain transition from a first value of the scale factor 144 to a second value of the scale factor 144.

Although the graph 330 illustrates a particular duration (20 samples) and slope of the amplitude difference smoothing 334, it should be appreciated that duration and/or slope of the amplitude difference smoothing 334 may vary. As an example, the duration and/or slope of the amplitude difference smoothing 334 may be dependent on the amount of inter-frame overlap and the particular values of the first and the second scale factors. Further, in some applications, the amplitude difference smoothing 334 may be non-linear (e.g., an exponential smoothing, a logarithmic smoothing, or a polynomial smoothing, such as a spline interpolation smoothing, as illustrative examples).

By enabling the amplitude difference smoothing 334 using a scaling "taper," amplitude differences between audio frames associated with an audio signal can be "smoothed." Smoothing amplitude differences may improve quality of audio signals at an electronic device.

Figure 4:
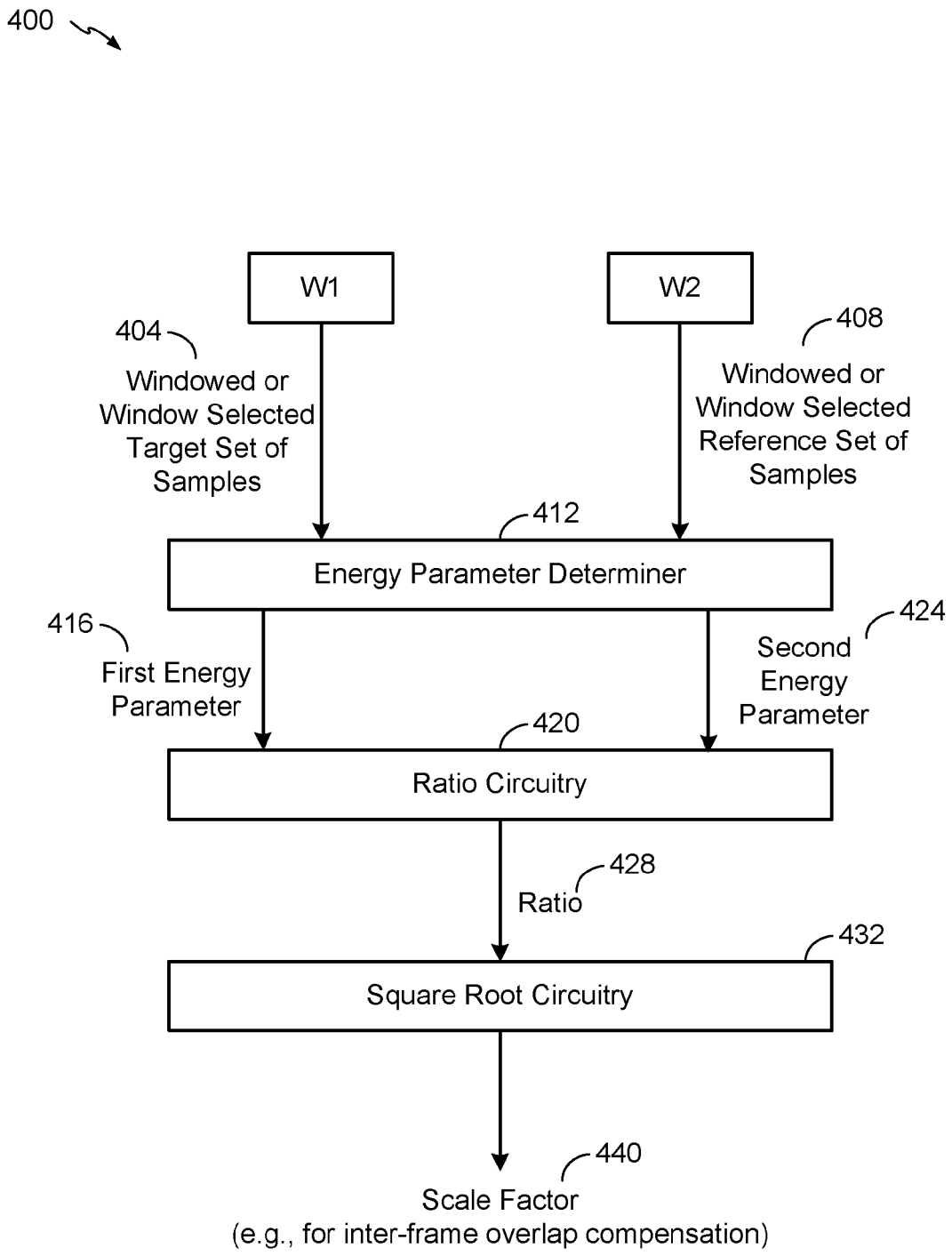
FIG. 4 is a block diagram of an illustrative example of a scale factor determiner, such as a scale factor determiner that may be included in the device of FIG. 1.

FIG. 4 is a block diagram of an illustrative example of a scale factor determiner 400. The scale factor determiner 400 may be integrated within the device 100 of FIG. 1. For example, the scale factor determiner 400 may correspond to the scale factor determiner 140 of FIG. 1.

The scale factor determiner 400 may include an energy parameter determiner 412 coupled to ratio circuitry 420. The scale factor determiner 400 may further include square root circuitry 432 coupled to the ratio circuitry 420.

During operation, the energy parameter determiner 412 may be responsive to a windowed or window selected target set of samples 404 (e.g., the windowed target sets of samples 132, 216). The energy parameter determiner 412 may also be responsive to a windowed or window selected reference set of samples 408 (e.g., the reference sets of samples 136, 228).

The energy parameter determiner 412 may be configured to determine a first energy parameter 416 associated with the windowed or window selected target set of samples 404. For example, the energy parameter determiner 412 may be configured to square each sample of the windowed or window selected target set of samples 404 and to sum the squared values to generate the first energy parameter 416.

The energy parameter determiner 412 may be configured to determine a second energy parameter 424 associated with the windowed or window selected reference set of samples 408. For example, the energy parameter determiner 412 may be configured to square each sample of the windowed or window selected reference set of samples 408 and to sum the squared values to generate the second energy parameter 424.

The ratio circuitry 420 may be configured to receive the energy parameters 416, 424. The ratio circuitry 420 may be configured to determine a ratio 428, such as by dividing the second energy parameter 424 by the first energy parameter 416.

The square root circuitry 432 may be configured to receive the ratio 428. The square root circuitry 432 may be configured to perform a square root operation on the ratio 428 to generate a scale factor 440. The scale factor 440 may correspond to the scale factor 144 of FIG. 1.

The example of FIG. 4 illustrates that a scale factor can be determined based on a windowed target set of samples and a windowed reference set of samples. The scale factor is representative of an energy ratio between samples in, or directly impacted by, the previous audio frame, as compared to samples in the current audio frame. The scale factor may be applied to a target set of samples to compensate for an inter-frame overlap, reducing or eliminating an energy discontinuity between the target set of samples and the reference set of samples.

Figure 5:
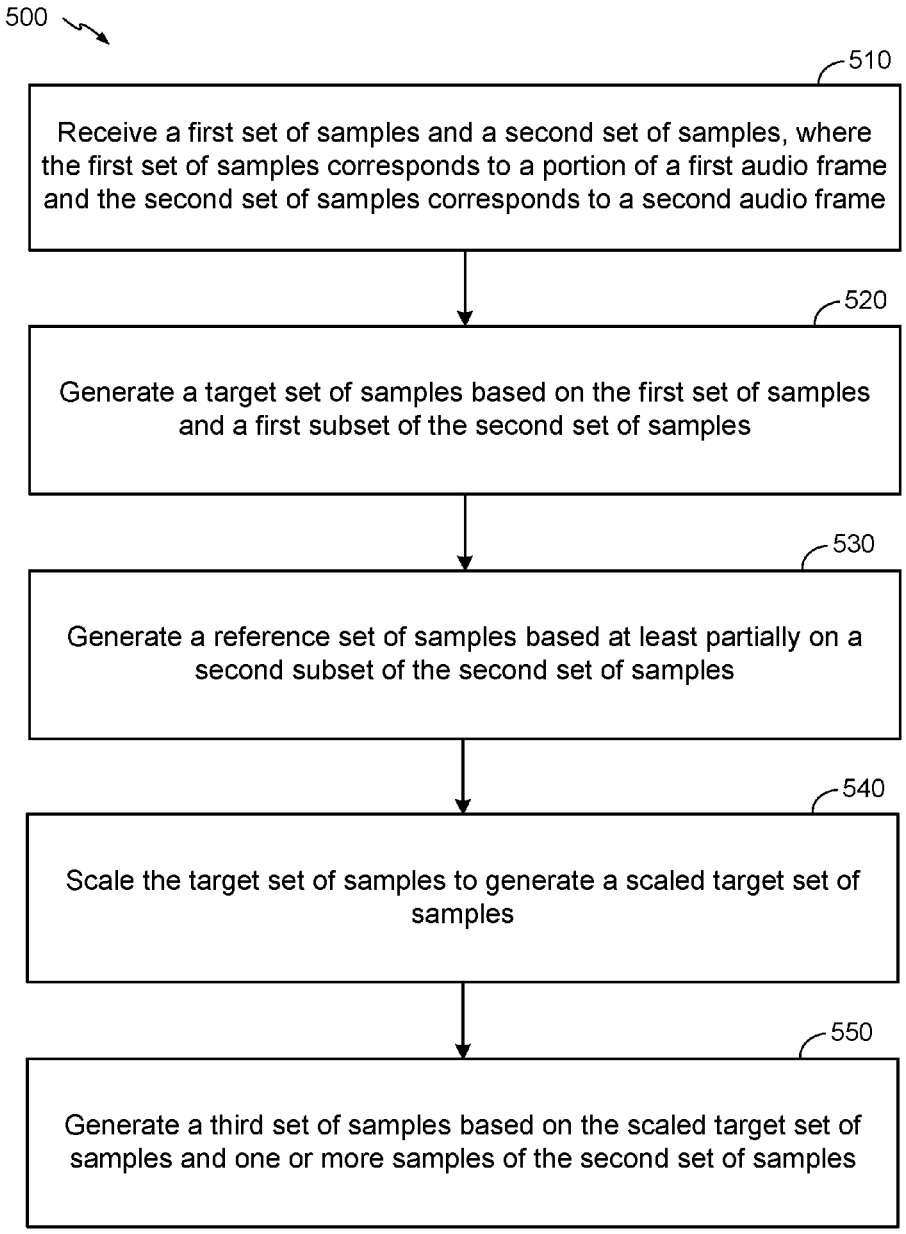
FIG. 5 is a flow chart that illustrates an example of a method of operation of a device, such as the device of FIG. 1.

FIG. 5 is a flow chart that illustrates an example of a method 500 of operation of a device. For example, the device may correspond to the device 100 of FIG. 1.

The method 500 includes receiving a first set of samples (e.g., any of the first sets of samples 124, 220) and a second set of samples (e.g., any of the second sets of samples 126, 224), at 510. The first set of samples corresponds to a portion of a first audio frame (e.g., the first audio frame 204) and the second set of samples corresponds to a second audio frame (e.g., the second audio frame 212).

The method 500 further includes generating a target set of samples based on the first set of samples and a first subset of the second set of samples, at 520. For example, the target set of samples may correspond to any of the target sets of samples 132, 216, and 404, and the first subset may correspond to the first subset 232. In some implementations, the target set of samples is generated based on a first window, the reference set of samples is generated based on a second window, and the first window overlaps the second window (e.g., as illustrated in the graph 320). In other implementations, the target set of samples is generated based on a first window, the reference set of samples is generated based on a second window, and the first window does not overlap the second window (e.g., as illustrated in the graph 310).

The method 500 further includes generating a reference set of samples based at least partially on a second subset of the second set of samples, at 530. For example, the reference set of samples may correspond to any of the reference sets of samples 136, 228, and 408, and the second subset may correspond to the second subset 236. In some embodiments, the reference set of samples includes the first subset (or weighted samples corresponding to the first subset), such as depicted in FIG. 2. In this case, the reference set of samples may be generated further based on the first subset of the second set of samples. In other embodiments, the reference set of samples does not include the first subset, such as in the case of an implementation corresponding to the graph 310.

The method 500 further includes scaling the target set of samples to generate a scaled target set of samples, at 540. For example, the scaled target set of samples may correspond to the scaled target set of samples 152.

The method 500 further includes generating a third set of samples based on the scaled target set of samples and one or more samples of the second set of samples, at 550. For example, the third set of samples may correspond to the third set of samples 160, and the one or more samples may correspond to the one or more samples 130. The one or more samples may include one or more remaining samples of the second set of samples.

The method 500 may further include providing the third set of samples to gain shape circuitry of the device. For example, the gain shape circuitry may correspond to the gain shape circuitry 164. In some implementations, the method 500 may optionally include scaling the third set of samples by the gain shape circuitry to generate a gain shape adjusted synthesized high-band signal (e.g., the gain shape adjusted synthesized high-band signal 168), such as in connection with either a decoder implementation or an encoder implementation. Alternatively, the method 500 may include estimating gain shapes by the gain shape circuitry based on the third set of samples, such as in connection with an encoder implementation.

The first set of samples and the second set of samples may correspond to synthesized high-band signals that are generated based on a low-band excitation signal using an excitation generator, a linear prediction synthesizer, and a post-processing unit of the device (e.g., using the circuitry 112). The first set of samples and the second set of samples may correspond to a high-band excitation signal that is generated based on a low-band excitation signal (e.g., the low-band excitation signal 104) using an excitation generator of the device.

The method 500 may optionally include storing the first set of samples at a memory of the device (e.g., at the memory 120), where the first subset of the second set of samples is selected by a selector coupled to the memory (e.g., by a selector included in the windower 128). The target set of samples may be selected based on a number of samples associated with an estimated length of an inter-frame overlap between the first audio frame and the second audio frame. The inter-frame overlap may be based on a total number of samples on either side of a boundary (e.g., the boundary 208) between the first audio frame and the second audio frame which are directly impacted by the first audio frame and are used in the second audio frame.

The method 500 may include generating a windowed or window selected target set of samples, generating a windowed or window selected reference set of samples, and determining a scale factor (e.g., the scale factor 144) based on the windowed or window selected target set of samples and the windowed or window selected reference set of samples, and where the target set of samples is scaled based on the scale factor. The target set of samples may be scaled using a smooth gain transition (e.g., based on the amplitude difference smoothing 334) from a first value of the scale factor to a second value of the scale factor. In some implementations, the second value of the scale factor may take a value of 1.0 and the first value may take the value of the estimated scale factor 440 or 144. In some implementations, determining the scale factor includes determining a first energy parameter (e.g., the first energy parameter 416) associated with the windowed or window selected target set of samples and determining a second energy parameter (e.g., the second energy parameter 424) associated with the windowed or window selected reference set of samples. Determining the scale factor may also include determining a ratio (e.g., the ratio 428) of the second energy parameter and the first energy parameter and performing a square root operation on the ratio to generate the scale factor.

The method 500 illustrates that a target set of samples may be scaled to compensate for inter-frame overlap between audio frames. For example, the method 500 may be performed to compensate for inter-frame overlap between the first audio frame 204 and the second audio frame 212 at the boundary 208.

To further illustrate, Examples 1 and 2 illustrative pseudo-code corresponding to instructions that may be executed by a processor to perform one or more operations described herein (e.g., one or more operations of the method 500 of FIG. 5). It should be appreciated that the pseudo-code of Examples 1 and 2 is provided for illustration and that parameters may differ from those of Example 1 based on the particular application.

In Example 1, "i" may correspond to the integer "n" described with reference to FIG. 3, "prev_energy" may correspond to the first energy parameter 416, "curr_energy" may correspond to the second energy parameter 424, "w1" may correspond to the first window w1(*n*) described with reference to the graph 310 or the graph 320, "w2" may correspond to the second window w2(*n*) described with reference to the graph 310 illustrating non-overlapping windows, "synthesized_highband" may correspond to the synthesized high-band signal 116, "scale factor" may correspond to the scale factor 144, "shaped_shb_excitation" may correspond to the third set of samples 160, and "actual scale" may correspond to the ordinate of the graph 330 (i.e., "scaling" in the graph 330). It should be noted that in some alternate illustrative, non-limiting examples, the windows "w1" and "w2" may be defined to be overlapping as illustrated in the graph 320.

EXAMPLE 1

```
prev_energy = 0;
curr_energy = 0;
for(i = 0; i < 340; i++)
{
    if(i<30) w1(i) = 1.0;
    else w1(n) = 0;
    if(i>=30 && i<60) w2(i) = 1.0;
    else w2(n) = 0;
}
for(i = 0; i < 20 + 10; i++)
{
    prev_energy +=
(w1[i]*synthesized_high_band[i])*(w1[i]*synthesized_high_band
[i]);/*0-29*/
    curr_energy +=
(w2[i+30]*synthesized_high_band[i+30])*(w2[i+30]*
synthesized_high_band[i+30]);/*30-59*/
}
scale_factor = sqrt(curr_energy/prev_energy);
if ((prev_energy )==0) scale_factor = 0;
for( i=0; i<20; i++ ) /*0-19*/
{
    actual_scale = scale_factor;
    shaped_shb_excitation[i] =
actual_scale*synthesized_high_band[i];
}
for(   ; i<30 ; i++) /*20-29*/
{
    temp = (i-19)/10.0f;
    /*tapering*/
    actual_scale = (temp*1.0f + (1.0f-temp)*scale_factor);
    shaped_shb_excitation[i] =
actual_scale*synthesized_high_band[i];
}
```

Example 2 illustrates an alternative pseudo-code which may be executed in connection with non-overlapping windows. For example, the graph 310 of FIG. 3 illustrates that the first window w1(*n*) and the second window w2(*n*) may be non-overlapping. One or more scaling operations described with reference to Example 2 may be as described with reference to the graph 330 of FIG. 3.

EXAMPLE 2

```
L_SHB_LAHEAD = 20;
        prev_pow = sum2_f( shaped_shb_excitation,
L_SHB_LAHEAD + 10 );
        curr_pow = sum2_f( shaped_shb_excitation +
L_SHB_LAHEAD + 10, L_SHB_LAHEAD + 10 );
        if( voice_factors[0] > 0.75f )
        {
            curr_pow *= 0.25;
        }
        if( prev_pow == 0 )
        {
            scale = 0;
        }
        else
        {
            scale = sqrt( curr_pow/ prev_pow );
        }
        for( i=0; i<L_SHB_LAHEAD; i++ )
        {
            shaped_shb_excitation[i] *= scale;
        }
        for(   ; i<L_SHB_LAHEAD + 10 ; i++)
        {
            temp = (i-19)/10.0f;
            shaped_shb_excitation[i] *= (temp*1.0f + (1.0f-
temp)*scale);
        }
```

In Example 2, the function "sum2_f" may be used to calculate the energy of a buffer input as the first argument to the function call, for a length of the signal input as the second argument to the function call. The constant L_SHB_LAHEAD is defined to take a value of 20. This value of 20 is an illustrative non-limiting example. The buffer voice factors holds the voice factors of the frame calculated one for each sub-frame. Voice factors are an indicator of the strength of the repetitive (pitch) component relative to the rest of the low-band excitation signal and can range from 0 to 1. A higher voice factor value indicates the signal is more voiced (meaning a stronger pitch component).

Figure 6:
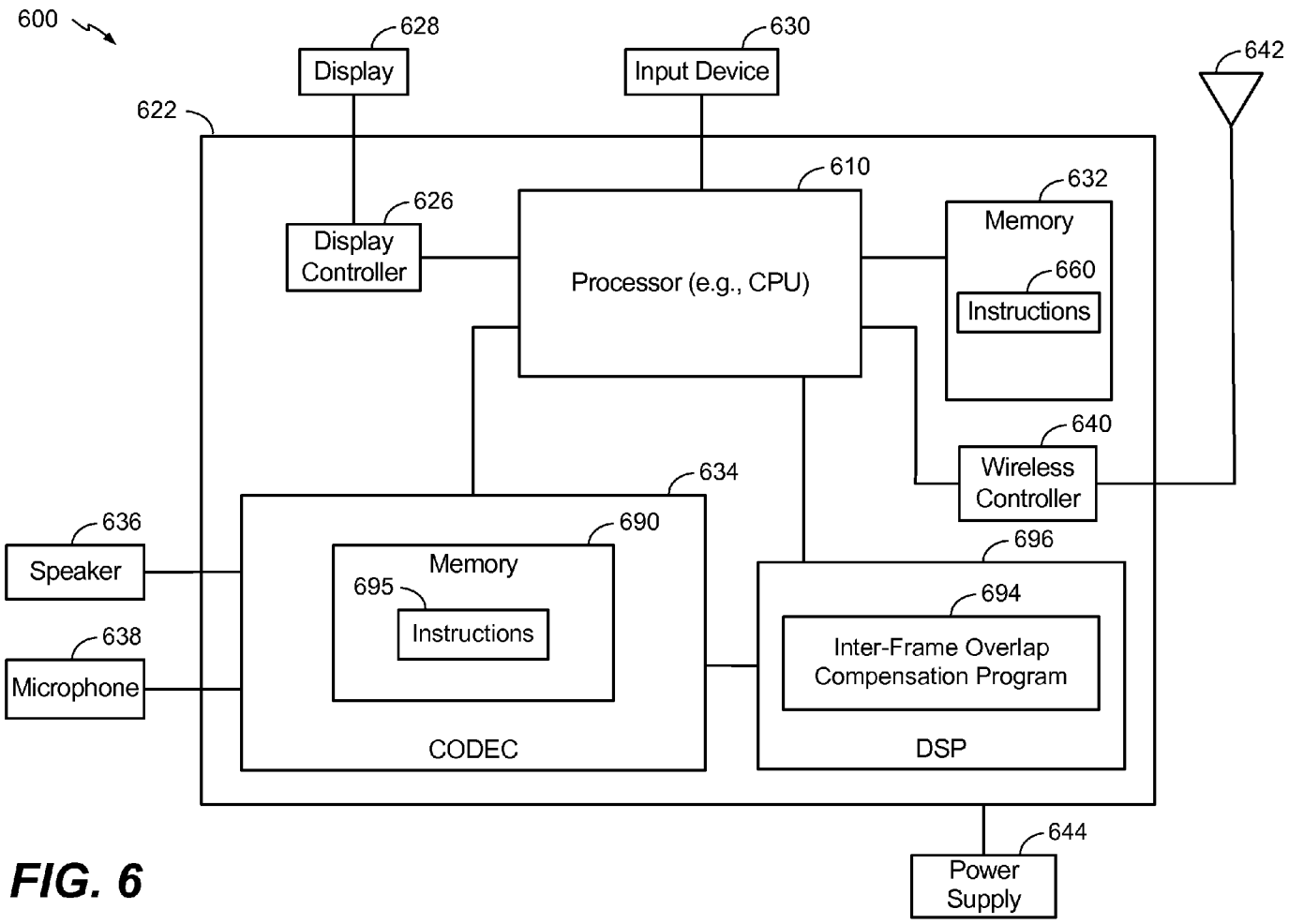
FIG. 6 is a block diagram of an illustrative example of an electronic device, such as an electronic device that includes the device of FIG. 1 and that uses the device of FIG. 1 to decode information received via a wireless communication network.

Examples 1 and 2 illustrate that operations and functions described herein may be performed or implemented using instructions executed by a processor. FIG. 6 describes an example of an electronic device that includes a processor that may execute instructions that correspond to the pseudo-code of Example 1, instructions that correspond to the pseudo-code of Example 2, or a combination thereof.

FIG. 6 is a block diagram of an illustrative example of an electronic device 600. For example, the electronic device 600 may correspond to or be integrated within a mobile device (e.g., a cellular telephone), a computer (e.g., a laptop computer, a tablet computer, or a desktop computer), a set top box, an entertainment unit, a navigation device, a personal digital assistant (PDA), a television, a tuner, a radio (e.g., a satellite radio), a music player (e.g., a digital music player and/or a portable music player), a video player (e.g., a digital video player, such as a digital video disc (DVD) player and/or a portable digital video player), an automotive system console, a home appliance, a wearable device (e.g., a personal camera, a head mounted display, and/or a watch), a robot, a healthcare device, or another electronic device, as illustrative examples.

The electronic device 600 includes a processor 610 (e.g., a central processing unit (CPU)) coupled to a memory 632. The memory 632 may be a non-transitory computer-readable medium that stores instructions 660 executable by the processor 610. A non-transitory computer-readable medium may include a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM).

The electronic device 600 may further include a coder/decoder (CODEC) 634. The CODEC 634 may be coupled to the processor 610. A speaker 636 can be coupled to the CODEC 634, and a microphone 638 can be coupled to the CODEC 634. The CODEC 634 may include a memory, such as a memory 690. The memory 690 may store instructions 695, which may be executable by a processing unit of the CODEC 634.

The electronic device 600 may also include a digital signal processor (DSP) 696. The DSP 696 may be coupled to the processor 610 and to the CODEC 634. The DSP 696 may execute an inter-frame overlap compensation program 694. For example, the inter-frame overlap compensation program 694 may be executable by the DSP 696 to perform one or more operations described herein, such as one or more operations of the method 500 of FIG. 5. Alternatively or in addition, the inter-frame overlap compensation program 694 may include one or more instructions that correspond to the pseudo-code of Example 1, one or more instructions that correspond to the pseudo-code of Example 2, or a combination thereof. It is noted that one or more operations described herein may be performed in connection with an encoding process, such as an encoding process performed to encode audio information that is detected by the microphone 638 and that is to be transmitted via the antenna 642. Alternatively or in addition, one or more operations described herein may be performed in connection with a decoding process, such as a decoding process performed to decode audio information that is received via the antenna 642 and that is used to produce an audio output at the speaker 636.

FIG. 6 also shows a display controller 626 that is coupled to the processor 610 and to a display 628. FIG. 6 also indicates that a wireless controller 640 can be coupled to the processor 610 and to an antenna 642.

In a particular example, the processor 610, the display controller 626, the memory 632, the CODEC 634, the wireless controller 640, and the DSP 696 are included in a system-in-package or system-on-chip device 622. An input device 630, such as a touchscreen and/or keypad, and a power supply 644 may be coupled to the system-on-chip device 622. Moreover, as illustrated in FIG. 6, the display 628, the input device 630, the speaker 636, the microphone 638, the antenna 642, and the power supply 644 may be external to the system-on-chip device 622. However, each of the display 628, the input device 630, the speaker 636, the microphone 638, the antenna 642, and the power supply 644 can be coupled to a component of the system-on-chip device 622, such as to an interface or a controller.

A computer-readable medium (e.g., any of the memories 632, 690) stores instructions (e.g., one or more of the instructions 660, the instructions 695, or the inter-frame overlap compensation program 694) executable by a processor (e.g., one or more of the processor 610, the CODEC 634, or the DSP 696) to perform operations. The operations include receiving a first set of samples (e.g., any or the first set of samples 124 or the first set of samples 220) and a second set of samples (e.g., any of the second set of samples 126 or the second set of samples 224). The first set of samples corresponds to a portion of a first audio frame (e.g., the first audio frame 204) and the second set of samples corresponds to a second audio frame (e.g., the second audio frame 212). The operations further include generating a target set of samples (e.g., any of the target set of samples 132 or the target set of samples 216) based on the first set of samples and a first subset (e.g., the first subset 232) of the second set of samples and generating a reference set of samples (e.g., any of the reference set of samples 136 or the reference set of samples 228) based at least partially on a second subset (e.g., the second subset 236) of the second set of samples. The operations further include scaling the target set of samples to generate a scaled target set of samples (e.g., the scaled target set of samples 152) and generating a third set of samples (e.g., the third set of samples 160) based on the scaled target set of samples and one or more samples (e.g., the one or more samples 130) of the second set of samples.

An apparatus includes means (e.g., the memory 120) for receiving a first set of samples (e.g., any or the first set of samples 124 or the first set of samples 220) and a second set of samples (e.g., any of the second set of samples 126 or the second set of samples 224). The first set of samples corresponds to a portion of a first audio frame (e.g., the first audio frame 204) and the second set of samples corresponds to a second audio frame (e.g., the second audio frame 212). The apparatus further includes means (e.g., the windower 128) for generating a target set of samples (e.g., any of the target set of samples 132 or the target set of samples 216) based on the first set of samples and a first subset (e.g., the first subset 232) of the second set of samples and for generating a reference set of samples (e.g., any of the reference set of samples 136 or the reference set of samples 228) based at least partially on a second subset (e.g., the second subset 236) of the second set of samples. The apparatus further includes means (e.g., the scaler 148) for scaling the target set of samples to generate a scaled target set of samples (e.g., the scaled target set of samples 152), means (e.g., the combiner 156) for generating a third set of samples (e.g., the third set of samples 160) based on the scaled target set of samples and one or more samples (e.g., the one or more samples 130) of the second set of samples.

In some examples, the apparatus further includes means (e.g., the gain shape circuitry 164) for receiving the third set of samples. The means for receiving the third set of samples may be configured to generate a gain shape adjusted synthesized high-band signal (e.g., the gain shape adjusted synthesized high-band signal 168) based on the third set of samples, such as in connection with either a decoder implementation of the device 100 or an encoder implementation of the device 100. Alternatively, the means for receiving the third set of samples may be configured to estimate gain shapes based on the third set of samples, such as in connection with an encoder implementation of the device 100. The apparatus may also include means for providing the first set of samples and the second set of samples to the means for receiving the first set of samples and the second set of samples. In an illustrative example, the means for providing includes one or more components described with reference to the circuitry 112, such as one or more of an excitation generator, a linear prediction synthesizer, or a post-processing unit, as illustrative examples.

Certain examples herein are described with reference to a decoder. Alternatively or in addition, one or more aspects described with reference to FIGS. 1-6 may be implemented at an encoder, such as an encoder that complies with a 3GPP protocol (e.g., a 3GPP EVS protocol). For example, an encoder of a device that transmits a signal in a wireless network and a decoder of a device that receives the signal via the wireless network may "cooperate" to reduce inter-frame overlap by performing operations described herein.

Figure 7:
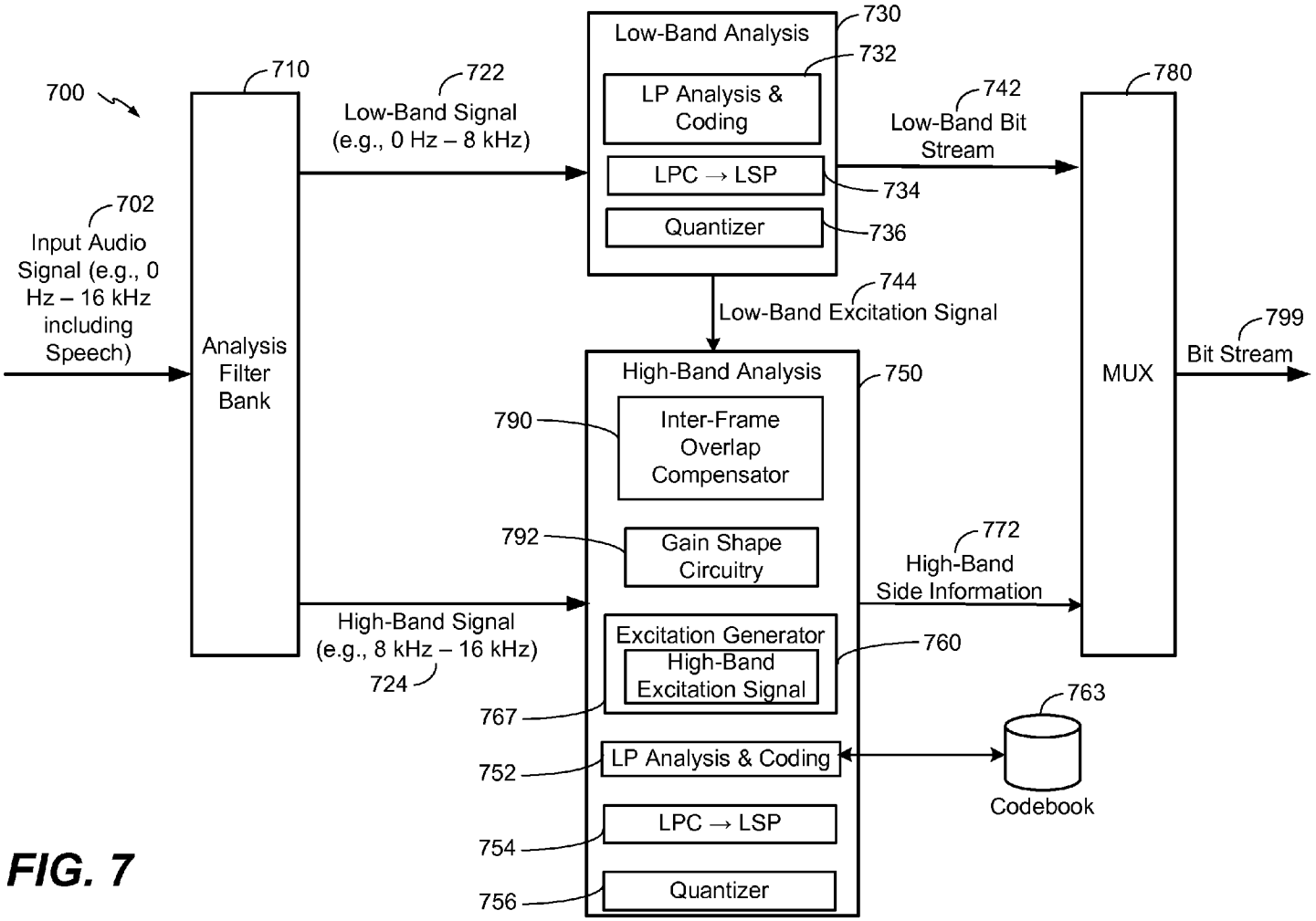
FIG. 7 is a block diagram of an illustrative example of a system, such as a system that may be integrated within the electronic device of FIG. 6 and that performs encoding operations to encode information to be transmitted via a wireless communication network.

Certain examples of encoding operations that may be performed by an encoder of a device are described further with reference to FIG. 7.

Referring to FIG. 7, an illustrative example of a system is shown and generally designated 700. In a particular embodiment, the system 700 may be integrated into an encoding system or apparatus (e.g., in a wireless telephone, a CODEC, or a DSP). To further illustrate, the system 700 may be integrated within the electronic device 600, such as within the CODEC 634 or within the DSP 696.

The system 700 includes an analysis filter bank 710 that is configured to receive an input audio signal 702. For example, the input audio signal 702 may be provided by a microphone or other input device. In a particular embodiment, the input audio signal 702 may represent speech. The input audio signal 702 may be a super wideband (SWB) signal that includes data in the frequency range from approximately 0 Hz to approximately 16 kHz.

The analysis filter bank 710 may filter the input audio signal 702 into multiple portions based on frequency. For example, the analysis filter bank 710 may generate a low-band signal 722 and a high-band signal 724. The low-band signal 722 and the high-band signal 724 may have equal or unequal bandwidth, and may be overlapping or non-overlapping. In an alternate embodiment, the analysis filter bank 710 may generate more than two outputs.

In the example of FIG. 7, the low-band signal 722 and the high-band signal 724 occupy non-overlapping frequency bands. For example, the low-band signal 722 and the high-band signal 724 may occupy non-overlapping frequency bands of 0 Hz-8 kHz and 8 kHz-16 kHz, respectively. In another example, the low-band signal 722 and the high-band signal 724 may occupy non-overlapping frequency bands 0 Hz-6.4 kHz and 6.4 kHz-12.8 kHz. In an another alternate embodiment, the low-band signal 722 and the high-band signal 724 overlap (e.g., 50 Hz-8 kHz and 7 kHz-16 kHz, respectively), which may enable a low-pass filter and a high-pass filter of the analysis filter bank 710 to have a smooth roll-off characteristic, which may simplify design and reduce cost of the low-pass filter and the high-pass filter. Overlapping the low-band signal 722 and the high-band signal 724 may also enable smooth blending of low-band and high-band signals at a receiver, which may result in fewer audible artifacts.

Although the example of FIG. 7 illustrates processing of a SWB signal, in some implementations the input audio signal 702 may be a wideband (WB) signal having a frequency range of approximately 50 Hz to approximately 8 kHz. In such an embodiment, the low-band signal 722 may, for example, correspond to a frequency range of approximately 50 Hz to approximately 6.4 kHz and the high-band signal 724 may correspond to a frequency range of approximately 6.4 kHz to approximately 8 kHz.

The system 700 may include a low-band analysis module 730 configured to receive the low-band signal 722. In a particular embodiment, the low-band analysis module 730 may represent an embodiment of a code excited linear prediction (CELP) encoder. The low-band analysis module 730 may include a linear prediction (LP) analysis and coding module 732, a linear prediction coefficient (LPC) to line spectral frequencies (LSFs) transform module 734, and a quantizer 736. LSPs may also be referred to as line spectral pairs (LSPs), and the two terms (LSP and LSF) may be used interchangeably herein.

The LP analysis and coding module 732 may encode a spectral envelope of the low-band signal 722 as a set of LPCs. LPCs may be generated for each frame of audio (e.g., 20 milliseconds (ms) of audio, corresponding to 320 samples), each sub-frame of audio (e.g., 5 ms of audio), or any combination thereof. The number of LPCs generated for each frame or sub-frame may be determined by the "order" of the LP analysis performed. In a particular embodiment, the LP analysis and coding module 732 may generate a set of eleven LPCs corresponding to a tenth-order LP analysis.

The LPC to LSP transform module 734 may transform the set of LPCs generated by the LP analysis and coding module 732 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 736 may quantize the set of LSPs generated by the transform module 734. For example, the quantizer 736 may include or be coupled to multiple codebooks that include multiple entries (e.g., vectors). To quantize the set of LSPs, the quantizer 736 may identify entries of codebooks that are "closest to" (e.g., based on a distortion measure such as least squares or mean square error) the set of LSPs. The quantizer 736 may output an index value or series of index values corresponding to the location of the identified entries in the codebook. The output of the quantizer 736 may thus represent low-band filter parameters that are included in a low-band bit stream 742.

The low-band analysis module 730 may also generate a low-band excitation signal 744. For example, the low-band excitation signal 744 may be an encoded signal that is generated by quantizing a LP residual signal that is generated during the LP process performed by the low-band analysis module 730. The LP residual signal may represent prediction error.

The system 700 may further include a high-band analysis module 750 configured to receive the high-band signal 724 from the analysis filter bank 710 and the low-band excitation signal 744 from the low-band analysis module 730. The high-band analysis module 750 may generate high-band side information 772 based on the high-band signal 724 and the low-band excitation signal 744. For example, the high-band side information 772 may include high-band LSPs and/or gain information (e.g., based on at least a ratio of high-band energy to low-band energy). In a particular embodiment, the gain information may include gain shape parameters generated by a gain shape module, such as gain shape circuitry 792 (e.g., the gain shape circuitry 164 of FIG. 1), based on a harmonically extended signal and/or a high-band residual signal. The harmonically extended signal may be inadequate for use in high-band synthesis due to insufficient correlation between the high-band signal 724 and the low-band signal 722. For example, sub-frames of the high-band signal 724 may include fluctuations in energy levels that are not adequately mimicked in a modeled high-band excitation signal 767.

The high-band analysis module 750 may include an inter-frame overlap compensator 790. In an illustrative implementation, the inter-frame overlap compensator 790 includes the windower 128, the scale factor determiner 140, the scaler 148, and the combiner 156 of FIG. 1. Alternatively or in addition, the inter-frame overlap compensator may correspond the inter-frame overlap compensation program 694 of FIG. 6.

The high-band analysis module 750 may also include a high-band excitation generator 760. The high-band excitation generator 760 may generate the high-band excitation signal 767 by extending a spectrum of the low-band excitation signal 744 into the high-band frequency range (e.g., 7 kHz-16 kHz). To illustrate, the high-band excitation generator 760 may mix the adjusted harmonically extended low-band excitation with a noise signal (e.g., white noise modulated according to an envelope corresponding to the low-band excitation signal 744 that mimics slow varying temporal characteristics of the low-band signal 722) to generate the high-band excitation signal 767. For example, the mixing may be performed according to the following equation:

$$\text{High-band excitation}=(\alpha*\text{adjusted harmonically extended low-band excitation})+((1-\alpha)*\text{modulated noise})$$

The ratio at which the adjusted harmonically extended low-band excitation and the modulated noise are mixed may impact high-band reconstruction quality at a receiver. For voiced speech signals, the mixing may be biased towards the adjusted harmonically extended low-band excitation (e.g., the mixing factor $\alpha$ may be in the range of 0.5 to 1.0). For unvoiced signals, the mixing may be biased towards the modulated noise (e.g., the mixing factor $\alpha$ may be in the range of 0.0 to 0.5).

As illustrated, the high-band analysis module 750 may also include an LP analysis and coding module 752, a LPC to LSP transform module 754, and a quantizer 756. Each of the LP analysis and coding module 752, the transform module 754, and the quantizer 756 may function as described above with reference to corresponding components of the low-band analysis module 730, but at a comparatively reduced resolution (e.g., using fewer bits for each coefficient, LSP, etc.). The LP analysis and coding module 752 may generate a set of LPCs that are transformed to LSPs by the transform module 754 and quantized by the quantizer 756 based on a codebook 763. For example, the LP analysis and coding module 752, the transform module 754, and the quantizer 756 may use the high-band signal 724 to determine high-band filter information (e.g., high-band LSPs) that is included in the high-band side information 772.

The quantizer 756 may be configured to quantize a set of spectral frequency values, such as LSPs provided by the transform module 754. In other embodiments, the quantizer 756 may receive and quantize sets of one or more other types of spectral frequency values in addition to, or instead of, LSFs or LSPs. For example, the quantizer 756 may receive and quantize a set of LPCs generated by the LP analysis and coding module 752. Other examples include sets of parcor coefficients, log-area-ratio values, and ISFs that may be received and quantized at the quantizer 756. The quantizer 756 may include a vector quantizer that encodes an input vector (e.g., a set of spectral frequency values in a vector format) as an index to a corresponding entry in a table or codebook, such as the codebook 763. As another example, the quantizer 756 may be configured to determine one or more parameters from which the input vector may be generated dynamically at a decoder, such as in a sparse codebook embodiment, rather than retrieved from storage. To illustrate, sparse codebook examples may be applied in coding schemes such as CELP and codecs according to industry standards such as 3GPP2 (Third Generation Partnership 2) EVRC (Enhanced Variable Rate Codec). In another embodiment, the high-band analysis module 750 may include the quantizer 756 and may be configured to use a number of codebook vectors to generate synthesized signals (e.g., according to a set of filter parameters) and to select one of the codebook vectors associated with the synthesized signal that best matches the high-band signal 724, such as in a perceptually weighted domain.

In a particular embodiment, the high-band side information 772 may include high-band LSPs as well as high-band gain parameters. For example, the high-band excitation signal 767 may be used to determine additional gain parameters that are included in the high-band side information 772.

The low-band bit stream 742 and the high-band side information 772 may be multiplexed by a multiplexer (MUX) 780 to generate an output bit stream 799. The output bit stream 799 may represent an encoded audio signal corresponding to the input audio signal 702. For example, the output bit stream 799 may be transmitted (e.g., over a wired, wireless, or optical channel) and/or stored.

At a receiver, reverse operations may be performed by a demultiplexer (DEMUX), a low-band decoder, a high-band decoder, and a filter bank to generate an audio signal (e.g., a reconstructed version of the input audio signal 702 that is provided to a speaker or other output device). The number of bits used to represent the low-band bit stream 742 may be substantially larger than the number of bits used to represent the high-band side information 772. Thus, most of the bits in the output bit stream 799 may represent low-band data. The high-band side information 772 may be used at a receiver to regenerate the high-band excitation signal from the low-band data in accordance with a signal model. For example, the signal model may represent an expected set of relationships or correlations between low-band data (e.g., the low-band signal 722) and high-band data (e.g., the high-band signal 724). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 750 at a transmitter may be able to generate the high-band side information 772 such that a corresponding high-band analysis module at a receiver is able to use the signal model to reconstruct the high-band signal 724 from the output bit stream 799. The receiver may include the device 100 of FIG. 1.

In the foregoing description, various functions and operations have been described as being implemented or performed by certain components or modules. It is noted that in some implementations, a function or operation described as being implemented or performed by a particular component or module may instead be implemented or performed using multiple components or modules. Moreover, in some implementations, two or more components or modules described herein may be integrated into a single component or module. One or more components or modules described herein may be implemented using hardware (e.g., a field-programmable gate array (FPGA) device, an application-specific integrated circuit (ASIC), a DSP, and/or a controller, as illustrative examples), software (e.g., instructions executable by a processor), or any combination thereof.

Those of skill would further appreciate that the various illustrative logical blocks, configurations, modules, circuits, and algorithm steps described in connection with the aspects disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the aspects disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A method of operation of a device, the method comprising:

receiving a first set of samples and a second set of samples, wherein the first set of samples corresponds to a portion of a first audio frame and the second set of samples corresponds to a second audio frame;

generating a first energy parameter associated with a target set of samples based on the first set of samples and a first subset of the second set of samples;

generating a second energy parameter associated with a reference set of samples that includes a second subset of the second set of samples; and based on the first energy parameter and the second energy parameter, scaling the target set of samples to generate a scaled target set of samples.

2. The method of claim 1, wherein the first audio frame sequentially precedes immediately before the second audio frame in an order of processing of the first audio frame and the second audio frame.

3. The method of claim 1, wherein the one or more samples include one or more remaining samples of the second set of samples.

4. The method of claim 1, further comprising scaling a third set of samples by gain shape circuitry of the device to generate a gain shape adjusted synthesized high-band signal, wherein the third set of samples is based on the scaled target set of samples and one or more samples of the second set of samples.

5. The method of claim 4, further comprising estimating gain shapes by gain shape circuitry of the device based on the third set of samples.

6. The method of claim 1, wherein the reference set of samples is generated further based on the first subset of the second set of samples.

7. The method of claim 1, wherein the first set of samples and the second set of samples correspond to synthesized high-band signals that are generated based on a low-band excitation signal using an excitation generator, a linear prediction synthesizer, and a post-processing unit of the device.

8. The method of claim 1, wherein the first set of samples and the second set of samples correspond to a high-band excitation signal that is generated based on a low-band excitation signal using an excitation generator.

9. The method of claim 1, further comprising storing the first set of samples at a memory of the device, wherein the first subset of the second set of samples is selected by a selector coupled to the memory.

10. The method of claim 1, wherein the target set of samples is selected based on a number of samples associated with an estimated length of an inter-frame overlap between the first audio frame and the second audio frame.

11. The method of claim 10, wherein the inter-frame overlap is based on a total number of samples on either side of a boundary between the first audio frame and the second audio frame which are directly impacted by the first audio frame and are used in the second audio frame.

12. The method of claim 1, further comprising determining a scale factor based on the target set of samples and the reference set of samples, wherein the target set of samples is scaled based on the scale factor.

13. The method of claim 12, wherein the target set of samples is scaled using a smooth gain transition from a first value of the scale factor to a second value of the scale factor.

14. The method of claim 13, wherein the second value of the scale factor is 1.0.

15. The method of claim 12, further comprising:

detertmining a ratio of the second energy parameter and the first energy parameter; and performing a square root operation on the ratio to generate the scale factor.

16. The method of claim 1, wherein scaling the target set of samples is performed by a device that comprises a mobile communication device.

17. The method of claim 1, wherein scaling the target set of samples is performed by a device that comprises a base station.

18. An apparatus comprising:

a memory configured to receive a first set of samples and a second set of samples, wherein the first set of samples corresponds to a portion of a first audio frame and the second set of samples corresponds to a second audio frame;

a windower configured to generate a target set of samples based on the first set of samples and a first subset of the second set of samples, the windower further configured to generate a reference set of samples that includes a second subset of the second set of samples; and a scaler configured to determine a first energy parameter associated with the target set of samples and a second energy parameter associated with the reference set of samples and to scale the target set of samples based on the first energy parameter and the second energy parameter to generate a scaled target set of samples.

19. The apparatus of claim 18, further comprising gain shape circuitry configured to generate a gain shape adjusted synthesized high-band signal based on a third set of samples that is based on the scaled target set of samples and one or more samples of the second set of samples.

20. The apparatus of claim 19, further comprising gain shape circuitry configured to estimate gain shapes based on the third set of samples.

21. The apparatus of claim 18, wherein the scaler is further configured to generate a scale factor based on the target set of samples and the reference set of samples and to scale the target set of samples based on the scale factor.

22. The apparatus of claim 18, wherein the windower is further configured to generate the reference set of samples based further on the first subset of the second set of samples.

23. The apparatus of claim 18, further comprising circuitry coupled to the memory, the circuitry configured to provide the first set of samples and the second set of samples to the memory.

24. The apparatus of claim 23, wherein the circuitry includes one or more of an excitation generator, a linear prediction synthesizer, or a post-processing unit.

25. The apparatus of claim 18, wherein the windower is further configured to generate the target set of samples based on a number of samples associated with an estimated length of an inter-frame overlap between the first audio frame and the second audio frame.

26. The apparatus of claim 25, wherein the inter-frame overlap is based on a total number of samples on either side of a boundary between the first audio frame and the second audio frame which are directly impacted by the first audio frame and are used in the second audio frame.

27. The apparatus of claim 18, further comprising a scale factor determiner configured to determine a scale factor based on the target set of samples and the reference set of samples, wherein the target set of samples is scaled based on the scale factor.

28. The apparatus of claim 27, wherein the scale factor determiner is further configured to scale the target set of samples using a smooth gain transition from a first value of the scale factor to a second value of the scale factor.

29. The apparatus of claim 27, wherein the scale factor determiner is further configured to determine a ratio of the second energy parameter and the first energy parameter and to perform a square root operation on the ratio to generate the scale factor.

30. The apparatus of claim 18, further comprising:

an antenna; and a receiver coupled to the antenna and configured to receive an encoded audio signal that includes the first frame and the second frame.

31. The apparatus of claim 30, wherein the windower, the memory, the scaler, the combiner, the receiver, and the antenna are integrated into a mobile communication device.

32. The apparatus of claim 30, wherein the windower, the memory, the scaler, the combiner, the receiver, and the antenna are integrated into a base station.

33. A non-transitory computer-readable medium storing instructions executable by a processor to perform operations, the operations comprising:

receiving a first set of samples and a second set of samples, wherein the first set of samples corresponds to a portion of a first audio frame and the second set of samples corresponds to a second audio frame;

generating a first energy parameter associated with a target set of samples based on the first set of samples and a first subset of the second set of samples;

generating a second energy parameter associated with a reference set of samples that includes a second subset of the second set of samples; and based on the first energy parameter and the second energy parameter, scaling the target set of samples to generate a scaled target set of samples.

34. The non-transitory computer-readable medium of claim 33, wherein the operations further comprise scaling a third set of samples to generate a gain shape adjusted synthesized high-band signal, wherein the third set of samples is based on the scaled target set of samples and one or more samples of the second set of samples.

35. The non-transitory computer-readable medium of claim 34, wherein the operations further comprise estimating gain shapes based on the third set of samples.

36. The non-transitory computer-readable medium of claim 33, wherein the reference set of samples is generated further based on the first subset of the second set of samples.

37. The non-transitory computer-readable medium of claim 33, wherein the first set of samples and the second set of samples correspond to synthesized high-band signals that are generated based on a low-band excitation signal using an excitation generator, a linear prediction synthesizer, or a post-processing unit.

38. The non-transitory computer-readable medium of claim 33, wherein the first set of samples and the second set of samples are received at a memory.

39. The non-transitory computer-readable medium of claim 33, wherein the target set of samples and the reference set of samples are generated by a windower.

40. The non-transitory computer-readable medium of claim 33, wherein the target set of samples is selected based on a number of samples associated with an estimated length of an inter-frame overlap between the first audio frame and the second audio frame.

41. The non-transitory computer-readable medium of claim 40, wherein the inter-frame overlap is based on a total number of samples on either side of a boundary between the first audio frame and the second audio frame which are directly impacted by the first audio frame and are used in the second audio frame.

42. The non-transitory computer-readable medium of claim 33, wherein the operations further comprise determining a scale factor based on the target set of samples and the reference set of samples, wherein the target set of samples is scaled based on the scale factor.

43. The non-transitory computer-readable medium of claim 42, wherein the operations further comprise:

determining a ratio of the second energy parameter and the first energy parameter; and performing a square root operation on the ratio to generate the scale factor.

44. The non-transitory computer-readable medium of claim 33, wherein the target set of samples is generated based on a first window, and wherein the reference set of samples is generated based on a second window.

45. The non-transitory computer-readable medium of claim 33, wherein scaling the target set of samples is performed by a device that comprises a mobile communication device.

46. The non-transitory computer-readable medium of claim 33, wherein scaling the target set of samples is performed by a device that comprises a base station.

47. The non-transitory computer-readable medium of claim 33, wherein the processor includes a digital signal processor (DSP), and wherein the instructions are included in an inter-frame overlap compensation program.

48. An apparatus comprising:

means for receiving a first set of samples and a second set of samples, wherein the first set of samples corresponds to a portion of a first audio frame and the second set of samples corresponds to a second audio frame;

means for generating a target set of samples and a reference set of samples, the target set of samples based on the first set of samples and a first subset of the second set of samples and the reference set of samples including a second subset of the second set of samples; and means for determining a first energy parameter associated with the target set of samples and a second energy parameter associated with the reference set of samples and for scaling the target set of samples based on the first energy parameter and the second energy parameter to generate a scaled target set of samples.

49. The apparatus of claim 48, further comprising means for receiving a third set of samples and for generating a gain shape adjusted synthesized high-band signal based on the third set of samples, wherein the third set of samples is based on the scaled target set of samples and one or more samples of the second set of samples.

50. The apparatus of claim 49, further comprising means for receiving the third set of samples and for estimating gain shapes based on the third set of samples.

51. The apparatus of claim 48, wherein the means for determining and for scaling is configured to generate a scale factor based on the target set of samples and the reference set of samples and to scale the target set of samples based on the scale factor.

52. The apparatus of claim 48, wherein the means for generating the target set of samples and the reference set of samples is configured to generate the reference set of samples further based on the first subset of the second set of samples.

53. The apparatus of claim 48, further comprising means for providing the first set of samples and the second set of samples to the means for receiving.

54. The apparatus of claim 53, wherein the means for receiving includes a memory, and wherein the means for providing includes one or more of an excitation generator, a linear prediction synthesizer, or a post-processing unit.

55. The apparatus of claim 48, wherein the means for generating the target set of samples and the reference set of samples is configured to generate the target set of samples based on a number of samples associated with an estimated length of an inter-frame overlap between the first audio frame and the second audio frame.

56. The apparatus of claim 55, wherein the inter-frame overlap is based on a total number of samples on either side of a boundary between the first audio frame and the second audio frame which are directly impacted by the first audio frame and are used in the second audio frame.

57. The apparatus of claim 48, further comprising means for determining a scale factor based on the target set of samples and the reference set of samples, wherein the target set of samples is scaled based on the scale factor.

58. The apparatus of claim 57, wherein the means for determining the scale factor includes a scale factor determiner.

59. The apparatus of claim 57, wherein the means for determining the scale factor is further configured to determine a ratio of the second energy parameter and the first energy parameter and to perform a square root operation on the ratio to generate the scale factor.

60. The apparatus of claim 48, wherein the means for generating the target set of samples and the reference set of samples is configured to generate the target set of samples based on a first window and to generate the reference set of samples based on a second window.

61. The apparatus of claim 60, wherein the first window overlaps the second window.

62. The apparatus of claim 60, wherein the first window does not overlap the second window.

* * * * *